US010320156B2

(12) United States Patent
Niessner et al.

(10) Patent No.: US 10,320,156 B2
(45) Date of Patent: Jun. 11, 2019

(54) SPARK PLUG AND METHOD FOR MANUFACTURING SAME

(71) Applicant: Federal-Mogul Ignition GmbH, Neuhaus-Schierschnitz (DE)

(72) Inventors: Werner Niessner, Steinheim (DE); Marko Schwesinger, Sonneberg (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 15/676,134

(22) Filed: Aug. 14, 2017

(65) Prior Publication Data

US 2018/0054043 A1 Feb. 22, 2018

(30) Foreign Application Priority Data

Aug. 16, 2016 (DE) ..... 10 2016 115 195
Aug. 2, 2017 (DE) ..... 10 2017 117 452

(51) Int. Cl.
*H01T 13/08* (2006.01)
*H01T 13/20* (2006.01)
*H01T 21/02* (2006.01)

(52) U.S. Cl.
CPC ..... *H01T 13/08* (2013.01); *H01T 13/20* (2013.01); *H01T 21/02* (2013.01)

(58) Field of Classification Search
USPC ..... 123/169 EL
See application file for complete search history.

(56) References Cited

U.S. PATENT DOCUMENTS 2,053,369 A 9/1936 Jeffery
2,300,646 A 11/1942 Buening
2,445,704 A 7/1948 Wolff
6,756,722 B2 6/2004 Hiramatsu
6,992,426 B2 1/2006 Francesconi
(Continued)

FOREIGN PATENT DOCUMENTS

DE 10201201168 A1 8/2012
EP 1476926 B1 6/2006
(Continued)

OTHER PUBLICATIONS

Reason for Refusal from Japanese Patent Office for Application No. JP2017-212557 dated Aug. 28, 2018; 2 pages.
(Continued)

*Primary Examiner* — Ashok Patel
(74) *Attorney, Agent, or Firm* — Reising Ethington, P.C.

(57) ABSTRACT

A spark plug and a method for manufacturing a spark plug. The spark plug has a retaining mechanism holding the insulator in the body in a positive manner, by means of which the insulator is pressed against the seal seat in the longitudinal direction with a preloading force (Fv) in order to seal the passage against the flow of combustion gases through it. A positive-acting securing mechanism that at least partially overlaps the side of the retaining mechanism facing away from the front end is placed on, and attached to, the body. Provision is made so that the insulator projects beyond the side of the securing mechanism facing away from the front end, wherein the securing mechanism overlaps the retaining mechanism, forming a gap with the retaining mechanism and forming a gap with the insulator.

13 Claims, 1 Drawing Sheet

(56) References Cited

U.S. PATENT DOCUMENTS

| | | | | |
|---|---|---|---|---|
| 7,402,941 | B2 | 7/2008 | Shibata | |
| 8,053,964 | B2 | 11/2011 | Maul | |
| 8,890,397 | B2 | 11/2014 | Lykowski | |
| 9,030,086 | B2 | 5/2015 | Durham | |
| 9,063,031 | B2 | 6/2015 | Zwollo et al. | |
| 9,088,136 | B2 | 7/2015 | Burrows | |
| 9,304,059 | B2 | 4/2016 | Burrows | |
| 2002/0195917 | A1* | 12/2002 | Hiramatsu | G01L 23/22 313/144 |
| 2010/0001626 | A1 | 1/2010 | Maul et al. | |
| 2010/0141110 | A1 | 6/2010 | Nakamura | |
| 2011/0043094 | A1 | 2/2011 | Suzuki | |

FOREIGN PATENT DOCUMENTS

| | | | |
|---|---|---|---|
| JP | 2014095708 | A | 5/2014 |
| JP | 2016100271 | A | 5/2016 |
| WO | WO2005114054 | A | 12/2005 |
| WO | 2010003733 | A1 | 1/2010 |

OTHER PUBLICATIONS

English Translation ofReason for Refusal from Japanese Patent Office for Application No. JP2017-212557 dated Aug. 28, 2018; 2 pages.

STITT spark plug catalogue—Engineering Features, p. EF 16, published at least as early as Aug. 15, 2016.

Office action issued by the National Intellectual Property Administration of the People's Republic of China for application 201710703378.1 dated Mar. 21, 2019.

Translation of the office action issued for application CN 201710703378.1 dated Mar. 21, 2019.

* cited by examiner

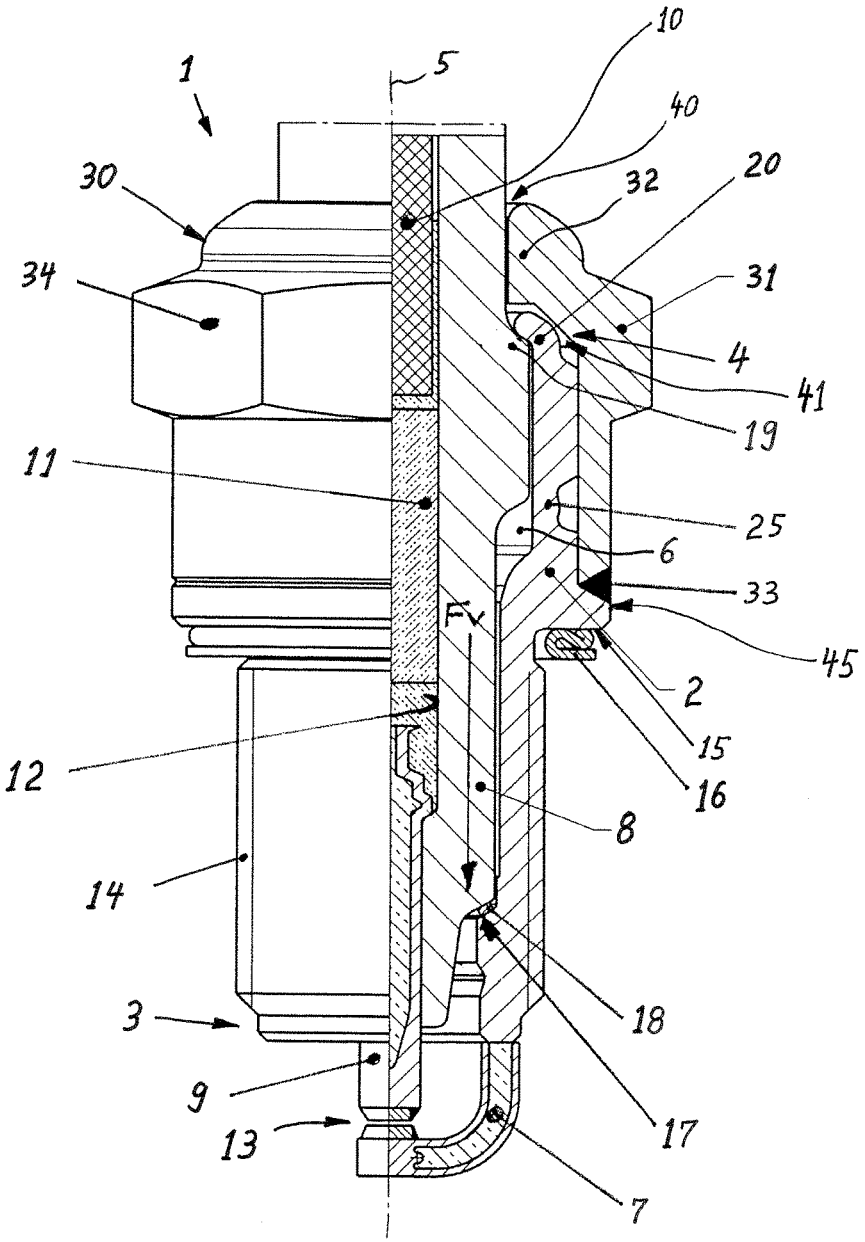
1
5
10
40
30
32
20
34
31
4
41
19
11
25
6
33
Fx
45
2
15
12
16
8
14
18
3
9
17
13
7

SPARK PLUG AND METHOD FOR MANUFACTURING SAME

REFERENCE TO RELATED APPLICATIONS

This application claims the benefit of German Application No. 10 2016 115195.5, filed on Aug. 16, 2016, and German Application No. 10 2017 117452.4, filed on Aug. 2, 2017, the contents of which are hereby incorporated by reference in their entirety.

FIELD

The present invention is generally related to spark plugs, and more particularly, to spark plugs designed for internal combustion engines.

SUMMARY

The disclosure relates to a spark plug and a method for manufacturing a spark plug.

Disclosed in DE 10 2012 101,168 A1 is a spark plug that contains a body having a passage in which an insulator is inserted in a gas-tight manner. At the back end of the body, the edge of the body is flanged inward after insertion of the insulator as a retaining mechanism for the insulator, and engages an insulator shoulder. The body has a shrinkage zone, in which the cross-section of the body is reduced, and which is heated by a current pulse and is upset with the simultaneous application of axial force. During the subsequent cooling, shrinkage of the body takes place in the region of the shrinkage zone so that the insulator is clamped in the body with an axial preloading force. This known method, which is frequently used in practice, is also called "electro-upsetting." The passage in the body, in particular the intermediate space between the insulator and the body, is sealed in this way against passage through it of combustion gases that act on the front end of the spark plug, which is in contact with the combustion chamber during operation of the internal combustion engine.

If the preloading force acting in the longitudinal direction decreases during a relatively long operating time of the spark plug, for example, due to fatigue of the body's material and/or an occasional overheating of the body, combustion gases may enter the intermediate space between insulator and body, or may even flow through the passage and escape from the combustion chamber of the internal combustion engine to the outside. This is undesirable. The flow of hot combustion gases through the passage leads to overheating of the spark plug and can even cause the strength of the flanged edge at the back end of the body to be reduced to such a degree that the insulator is pushed out of the body to the rear. The insulator can be driven out in projectile fashion by the highly pressurized combustion gases and cause considerable damage.

A spark plug and a manufacturing method of the initially mentioned type are known from
DE 10 2006 043,593 B3. The known spark plug contains a body having a passage in which an insulator is located and is retained in the passage under preloading force by means of a positive-acting retaining mechanism. Attached to the body is a securing mechanism acting in a positive manner that overlaps, at a very great distance, the side of the retaining mechanism facing away from the front end. The securing mechanism contains a tubular housing and a hexagon welded onto the back end that is intended to prevent spark plug parts, in particular the insulator, from being ejected from the tubular housing in the event of a failure of the retaining mechanism when dangerously high peak pressures occur. The tubular housing contains at least one vent opening in its lateral surface through which an overpressure can be relieved in the radial direction. Located in the back part of the tubular housing is a Teflon seal ring that prevents the entry of leakage gases into a back region where a center conductor exits the back end of the insulator. The tubular housing has a smooth inner wall that is continuous up to the hexagon, so if ejection of the insulator were to occur in the event of a failure, the insulator is first accelerated over a very long distance and then collides at high speed with the narrowing formed by the hexagon.

Disclosed in DE 10 2008 040,285 A1 is a special form of a spark plug optimized for installation space, which requires a special design of the cylinder head. Here, the body has no external thread for screwing into the cylinder head. Instead, a clamping nut is provided in the region of the back end of the body, and has an external thread that is screwed into a corresponding internal thread of the cylinder head, pressing the body of the spark plug in the direction of the combustion chamber against a seal seat. Due to a suitable design of the insulator, the clamping nut prevents it from being driven backward out of the body in the event of a failure.

DE 102 27 371 A1 discloses a spark plug with a piezoelectric sensor, wherein the sensor is arranged, with no gap, between a retaining mechanism of the insulator and a sleeve overlapping the back end of the insulator in order to measure changing deformation of the retaining mechanism with varying combustion pressures. Facing the front end of the body, the sleeve has an end section with sharply reduced cross-section that is welded onto a cylindrical section of the body. This thin-walled end section of the sleeve is not strong enough to stop an insulator that is accelerated backward out of the body in the event of failure of the retaining mechanism. Known from U.S. Pat. No. 2,300,646 A is a spark plug that has a body and a retaining mechanism for the insulator, wherein a rubber cap that overlaps the retaining mechanism is placed on the back end of the body. Such a rubber cap is likewise unsuitable for preventing ejection of the insulator in the event of failure of the retaining mechanism. EP 1,265,328 A1 discloses a spark plug containing a body assembled from multiple parts between which the insulator is held. The housing parts are preloaded against one another in their contact region by a welding process to achieve sealing of the insulator in the body.

An object of the present disclosure is to improve a spark plug and a method of the initially mentioned type.

The object can be attained by a spark plug with one or more of the features as described herein, and/or a manufacturing a method as described herein. Advantageous improvements to the spark plug and the methods described herein are the subject matter of the dependent claims.

The spark plug has a metal body with a front end and a back end, a longitudinal direction and a passage extending in the longitudinal direction. At least one ground electrode connected in an electrically conductive manner to the body can be located at the front end. An insulator containing a center electrode is located in the passage. The center electrode projects out of the insulator in the region of the front end, and, together with the at least one ground electrode, can form a spark gap or a spark air gap. In the region of its front end, the body has, located in the passage, a seal seat for the insulator. In the region of its back end, the body has a retaining mechanism holding the insulator in the body in a positive manner, by means of which the insulator is pressed against the seal seat in the longitudinal direction with a preloading force in order to seal the passage against the flow of combustion gases through it. The retaining mechanism can be designed to be ring-shaped, in particular as a continuous ring shape around the insulator.

The retaining mechanism can be formed by a narrowing of the passage in the body. The retaining mechanism can in particular be formed by an edge of the body that is flanged after insertion of the insulator. The insulator can have an insulator shoulder, pointing toward the back end, that the retaining mechanism of the body engages. The body can be designed as a single continuous piece at least in its section extending from the seal seat to the retaining mechanism, in particular including the seal seat and retaining mechanism.

The insulator can have a shoulder that faces the front end of the body and rests against the seal seat of the body, in particular with a seal ring interposed. The insulator can likewise contain a passage extending in the longitudinal direction, in which the center electrode is located. An igniter that projects from the back end of the insulator and can be used to connect a supply line can be located in the passage of the insulator. The igniter and the center electrode are connected to one another inside the passage of the insulator by an electrically conductive fused glass element that simultaneously seals the passage in the insulator against the flow of combustion gases through it.

A positive-acting securing mechanism that at least partially overlaps the side of the retaining mechanism facing away from the front end is attached to the body. According to one embodiment, the insulator projects past the side of the securing mechanism facing away from the front end. The securing mechanism overlaps the retaining mechanism, forming a gap to the retaining mechanism as well as forming a gap to the insulator. Both gaps are small. The gap between the securing mechanism and the retaining mechanism and/or the gap between the securing mechanism and the insulator can be a maximum of 2 mm, in particular a maximum of 1 mm. The body can have, facing toward the back end, an external shoulder to which the securing mechanism is attached. The securing mechanism can include a ring-shaped section that surrounds the insulator while forming a gap, and overlaps the retaining mechanism while forming a gap. The inner contour of the ring-shaped section of the securing mechanism can, in particular, be matched to the outer contour of the retaining mechanism and/or of the insulator projecting from the back end of the body.

In the method for manufacturing a spark plug, first an insulator is placed in a body having a passage and is fixed in place therein by a positive-acting retaining mechanism. A forming of the retaining mechanism and the fixing in place of the insulator can be carried out in a manner known per se, for example in that an edge at the back end of the body is flanged after insertion of the insulator. Next, a positive-acting securing mechanism is placed on the body in a manner that at least partially overlaps the retaining mechanism, and is joined to the body. During placement, the securing mechanism is slipped onto the body in the longitudinal direction in such a manner that the insulator projects beyond the side of the securing mechanism facing away from the front end. Moreover, the securing mechanism is slipped on in such a manner that it contacts the external shoulder of the body, in particular with no gap, while a section of the securing mechanism that overlaps the retaining mechanism forms a gap in each case with the retaining mechanism as well as with the insulator. The securing mechanism can be joined to the body, in particular to its external shoulder, by welding. The securing mechanism and the body can be welded to one another continuously in the circumferential direction of the body, in particular by mechanism of a weld seam extending around the entire circumference of the body. In particular, provision can be made that the body is upset in the longitudinal direction between the external shoulder and the retaining mechanism after insertion of the insulator, and that the securing mechanism is not placed and attached until after the upsetting.

One or more embodiments may have important advantages:

The securing mechanism reliably secures the insulator in the body if the retaining mechanism should fail. A failure of the retaining mechanism can be caused by, for example, material fatigue or overheating of the spark plug, and can—as described above—represent a high safety risk.

If the retaining mechanism should fail, the securing mechanism immediately captures the insulator due to the small gap and prevents the insulator from being accelerated to a high speed over a long distance and expelled from the body. The insulator is prevented from flying about.

The well-proven method, which is known per se, for installing the insulator in the body, in which an edge at the back end of the body is flanged and then a preloading force acting on the insulator in the longitudinal direction of the spark plug is created by electro-upsetting of a shrinkage zone, can continue to be used, namely, before the securing mechanism is put in place, in particular.

The securing mechanism, for example in the form of a securing sleeve, can be attached to the back end of the body without great effort.

The securing mechanism functions reliably even in a high temperature region, in particular up to 700° C.

The gap, in particular annular gap, between the securing mechanism and the insulator ensures an escape of hot gases in the axial direction in the event of a failure, such as also previously occurred in the spark plugs without securing mechanism that are known from DE 10 2012 101,168 A1. There is no need for any additional openings in the securing mechanism, which would weaken its cross-section as in DE 10 2006 043,593 B3. Furthermore, this narrow gap causes a degree of centering of the insulator in the event of a failure. During normal operation, in contrast, it ensures that the securing mechanism does not exert any undesirable forces on the insulator. Safety can be improved overall by this mechanism.

If the inner contour of the securing mechanism is matched to the outer contour of the retaining mechanism, then the retaining mechanism, which expands rearward in the event of a failure, can rest against the securing mechanism immediately after crossing the negligible gap and is reliably supported there without the possibility of strong acceleration of the insulator.

The gap between the securing mechanism and the retaining mechanism ensures that the securing mechanism can be slid onto the body until it contacts the external shoulder and that a reliable joint, in particular a weld seam, can be produced there. In particular, the gap between the securing mechanism and the retaining mechanism is chosen to be chosen to be just large enough to ensure that that the securing mechanism can contact the external shoulder of the body in a defined manner without the section of the securing mechanism that overlaps the retaining mechanism touching the retaining mechanism, even when manufacturing tolerances of the individual components occur. In this way, reliable manufacturing of the spark plug can be ensured.

In an embodiment, the securing mechanism can have a securing sleeve that is placed on the back end of the body. The securing sleeve can, in particular, be pushed or screwed onto the back end of the body. For attachment of the securing sleeve, it can be welded to the body. The body can be made in the shape of a circular cylinder at its back end for the securing sleeve to be pushed on. The ring-shaped section of the securing mechanism can be composed of a narrowing, particularly extending continuously in a ring shape, of the inner contour of the securing sleeve. The end of the securing sleeve opposite the narrowing can be welded to the external shoulder of the body. By means of the combination of the external shoulder and the securing sleeve attached thereto, it is possible to maintain an outer contour of the spark plug corresponding to established standards that can continue to be used in standardized cylinder heads.

In another embodiment, provision can be made such that the spark plug contains a screw-in mechanism and an external thread located at the front end of the body for screwing the spark plug into an internal combustion engine. The screw-in mechanism is arranged on the securing sleeve and can be formed, in particular, by wrench engagement surfaces, as, for example, a hexagon. The outer contour of the body at the back end and the matching inner contour of the securing sleeve can have a cross-section differing from the circular shape, in particular, grooves extending in the longitudinal direction or longitudinal teeth. In this way, the torque transmission from the screw-in mechanism located on the securing sleeve to the body can be improved. The body can have a shrinkage zone for electro-upsetting located between the external thread and the retaining mechanism. The shrinkage zone can in particular be located between the retaining mechanism and the backward-facing external shoulder for attachment of the securing device. The securing sleeve can cover the shrinkage zone and can be joined, in particular welded, to the body between the shrinkage zone and the external thread. As a result of this design, the securing sleeve can also protect the shrinkage zone, where the cross-section of the body is reduced, along with the retaining mechanism. Protection from a material failure of the body and ejection of the insulator can be increased in this way. As a result, the shrinkage zone is no longer stressed by the tightening torque when the spark plug is screwed in. This can avoid undesirable damage to the shrinkage zone that can cause leakage.

The body can have, between the external thread and the attachment region of the securing mechanism, an external shoulder pointing towards the front end of the body that limits the process of screwing the spark plug into the internal combustion engine and seals the spark plug with respect to the internal combustion engine. The spark plug can include a seal ring resting against the shoulder. A heat removal from the spark plug to the internal combustion engine and a cooling circuit located therein is accomplished through the external thread and the external shoulder of the body.

The securing mechanism can be designed as a single continuous piece, at least from its section overlapping the retaining mechanism, in particular its ring-shaped section, to its point of attachment to the body. In particular, the securing mechanism can be designed completely as a single piece. The securing mechanism, particularly the securing sleeve, can be made of a material with high heat resistance, particularly a nickel-based alloy. The nickel-based alloys with material No. 2.4816 (also known by the brand name INCONEL 600) and with material No. 2.4851 (also known by the brand name INCONEL 601) are especially suitable. Such a design of the securing mechanism can improve its stability and safety.

DRAWINGS

Preferred exemplary embodiments of the invention will hereinafter be described in conjunction with the appended drawings, wherein like designations denote like elements, and wherein:

FIG. 1 a longitudinal half-section of a spark plug according to one embodiment.

DESCRIPTION

Partially shown in FIG. 1 is a spark plug 1 that contains a metal body 2. The body 2 has a front end 3 and a back end 4, as well as a longitudinal direction 5 and a passage 6 extending in the longitudinal direction 5. Welded to the face of the body 2 at the front end 3 is a ground electrode 7. Located in the passage 6 is an insulator 8 which contains a center electrode 9, an igniter 10 and a fused glass element 11. The center electrode 9 projects out of the insulator 8 in the region of the front end 3 and, together with the ground electrode 7, forms a spark gap 13. The insulator 8 has a passage 12, in which the center electrode 9, igniter 10 and fused glass element 11 are located. At its front end 3, the body 2 has an external thread 14 for screwing the spark plug 1 into an internal combustion engine, which thread is adjacent to an external shoulder 15, facing the front end 3, that a seal ring 16 rests against.

In the region of its front end 3, the body 2 has a seal seat 17 that is in the form of an internal shoulder and is located in the passage 6; the insulator 8 rests against this shoulder with a seal ring 18 interposed. In the region of its back end 4, the body 2 has a retaining mechanism 20 that is formed by the inwardly flanged back edge of the body 2 and rests against a shoulder 19 of the insulator 8. The body 2 additionally has a shrinkage zone 25, which represents a zone of reduced cross-section. The body 2 is designed as a single piece in a section that includes at least the seal seat 17, the retaining mechanism 20 and the shrinkage zone 25.

Fastened to the back end 4 is a securing mechanism 30 in the form of a securing sleeve 31 which secures the retaining mechanism 20 in a positive manner, and, for this purpose, overlaps the side of the retaining mechanism 20 facing away from the front end 3. The insulator 8 projects beyond the side of the securing mechanism 30 facing away from the front end 3. The securing mechanism 30 contains a ring-shaped section 32 that is formed by a continuous ring-shaped narrowing of the inner contour of the securing sleeve 31 and that surrounds the insulator 8 in its region projecting from the back end 4, forming a gap 40. In the depiction in FIG. 1, the cylindrical gap 41 is so small that it is not continuously visible. The section 32 overlaps the retaining mechanism 20, forming a gap 41, and captures the insulator 8 at its shoulder 19 in the event that the retaining mechanism 20 can no longer retain the insulator 8 due to material failure. The securing mechanism 30 thus prevents the possibility that the insulator 8 can be driven out of the back end 4 of the body 2 by the high combustion pressure arising in the combustion chamber of the internal combustion engine in the event that the retaining mechanism 20 fails.

The securing sleeve 31 is pushed onto the back end 4 and is welded to the body 2 in the region between the external thread 14 and the shrinkage zone 25. The weld seam is indicated by the reference symbol 33, and is located between the shrinkage zone 25 and the external shoulder 15. This ensures that the securing sleeve 31 covers the shrinkage zone 25 and that its reduced cross-section is likewise protected. The securing sleeve 31 contains a screw-in mechanism 34 in the form of an external hexagon for application of a tightening tool. The tightening torque is transmitted through the securing sleeve 31 and the weld seam 33, past the reduced cross-section of the shrinkage zone 25, to the body 2.

When the spark plug 1 is manufactured, the back edge 20 of the body 2 has initially not yet been flanged, and the passage 6 does not yet have a narrowing at the back end 4. The seal ring 18 and the insulator 8 are inserted into the passage 6. Next, the edge 20 is flanged and forms the retaining mechanism for the insulator 8. After that, the shrinkage zone 25 is heated by a current pulse flowing through the body 2 while axial force is applied between the front end 3 and the back end 4. In this way, the material in the region of the shrinkage zone 25 is upset. The shrinkage zone 25 shrinks further during the subsequent cooling thereof so that an axial clamping of the insulator 8 in the spark plug body 2 occurs, which is indicated by the preloading force Fv and presses the insulator 8 against the seal seat 17, so that the passage 6 is sealed against inflow and passage through it of combustion gases from the combustion chamber of the internal combustion engine. Next, the securing mechanism 30 is placed on the back end 4 of the body 2 and is joined thereto by the weld seam 33. The weld seam 33 extends along the entire circumference of the body 2 and the securing sleeve 31.

The body 2 has an external shoulder 45 that faces toward the back end 4 and that the securing sleeve 31 contacts when it is set in place. When the securing sleeve 31 contacts the external shoulder 45, the gap 41 between the inner contour of the ring-shaped section 32 and the retaining mechanism 20 ensures that the securing mechanism 30 can be installed while ensuring a defined location without being statically overdetermined. In this way, it is possible to ensure an especially stable and secure weld seam 33 at an essentially gap-free line of contact between the bottom edge of the securing sleeve 31 and the external shoulder 45. A stable weld seam 33 without interruptions or air inclusions is important so that the securing sleeve 31 can actually perform its safety function.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

1 spark plug
2 body
3 front end
4 back end
5 longitudinal direction
6 passage
7 ground electrode
8 insulator
9 center electrode
10 igniter
11 fused glass element
12 passage
13 spark gap
14 external thread
15 external shoulder
16 seal ring
17 seal seat
18 seal ring
19 shoulder
20 retaining mechanism
25 shrinkage zone
30 securing mechanism
31 securing sleeve
32 ring-shaped section
33 weld seam
34 screw-in mechanism
40 gap
41 gap
45 external shoulder
Fv preloading force

The invention claimed is:

1. A spark plug comprising:

a metal body with a front end, a back end, a longitudinal direction, and a passage extending in the longitudinal direction;

located in the passage is an insulator that contains a center electrode that projects out of the insulator in a region of the front end;

in the region of the front end, the body has, located in the passage, a seal seat for the insulator, and in the region of its back end, the body has a retaining mechanism holding the insulator in the body in a positive manner, such that the insulator is configured to be pressed against the seal seat in the longitudinal direction with a preloading force in order to seal the passage against the flow of combustion gases;

a positive-acting securing mechanism that at least partially overlaps the side of the retaining mechanism facing away from the front end is attached to the body, wherein a shoulder of the insulator projects beyond the side of the securing mechanism facing away from the front end, wherein the securing mechanism overlaps the retaining mechanism, forming a first gap with the retaining mechanism and forming a second gap with the insulator, wherein the securing mechanism contains a ring-shaped section that surrounds the insulator, forming the second gap, and overlaps the retaining mechanism, forming the first gap, and wherein an inner contour of the ring-shaped section is matched to an outer contour of the retaining mechanism, an outer contour of the insulator, or an outer contour of both the retaining mechanism and the insulator, wherein the second gap is at least partially located directly between a portion of the retaining mechanism that overlaps the shoulder of the insulator and a portion of the ring-shaped section that overlaps the shoulder of the insulator.

2. The spark plug according to claim 1, wherein the body has, facing toward the back end, an external shoulder to which the securing mechanism is attached.

3. The spark plug according to claim 2, wherein the securing mechanism has a securing sleeve that is placed on the external shoulder of the body and is welded to the external shoulder by mechanism of a weld seam extending around the entire circumference, wherein a bottom edge of the securing sleeve rests on a portion of the external shoulder that faces the back end.

4. The spark plug according to claim 3, further comprising a screw-in mechanism and an external thread that is located at the front end of the body for screwing the spark plug into an internal combustion engine, wherein the screw-in mechanism is arranged on the securing sleeve.

5. The spark plug according to claim 3, wherein the body has a shrinkage zone located between the external thread and the retaining mechanism, wherein the securing sleeve covers the shrinkage zone and is joined to the body between the shrinkage zone and the external thread.

6. The spark plug according to claim 1, wherein there is located at the front end at least one ground electrode that is connected in an electrically conductive manner to the body and that forms a spark gap with the center electrode.

7. The spark plug according to claim 1, wherein the first gap between the securing mechanism and the retaining mechanism, the second gap between the securing mechanism and the insulator, or both the first gap between the securing mechanism and the retaining mechanism and the second gap between the securing mechanism and the insulator is a maximum of 2 mm.

8. The spark plug according to claim 1, wherein the securing mechanism is designed as a single continuous piece, at least from a section overlapping the retaining mechanism to a point of attachment to the body.

9. The spark plug according to claim 1, wherein the body is designed as a single continuous piece, at least in a section that extends from the seal seat to the retaining mechanism and including the seal seat and the retaining mechanism.

10. A spark plug comprising:

a metal body with a front end, a back end, an external shoulder facing toward the back end, a longitudinal direction, and a passage extending in the longitudinal direction;

located in the passage is an insulator that contains a center electrode that projects out of the insulator in a region of the front end;

in the region of the front end, the body has, located in the passage, a seal seat for the insulator, and in the region of its back end, the body has a retaining mechanism holding the insulator in the body in a positive manner, such that the insulator is configured to be pressed against the seal seat in the longitudinal direction with a preloading force in order to seal the passage against the flow of combustion gases;

a positive-acting securing mechanism that at least partially overlaps the side of the retaining mechanism facing away from the front end is attached to the body, having a securing sleeve with a bottom edge, the bottom edge rests on a portion of the external shoulder of the body that faces the back end, wherein the insulator projects beyond the side of the securing mechanism facing away from the front end, wherein the securing mechanism overlaps the retaining mechanism, forming a gap with the retaining mechanism and forming a gap with the insulator; and a screw-in mechanism and an external thread that is located at the front end of the body for screwing the spark plug into an internal combustion engine, wherein the screw-in mechanism is arranged on the securing sleeve.

11. A method for manufacturing the spark plug of claim 1, comprising the steps of:

placing the insulator in the body, and fixing the insulator in place therein by the positive-acting retaining mechanism;

placing the positive-acting securing mechanism on the external shoulder of the body in a manner that at least partially overlaps the retaining mechanism, wherein the body is upset in the longitudinal direction between the external shoulder and the retaining mechanism after insertion of the insulator; and joining the external shoulder and the positive-acting securing mechanism, wherein during placement of the positive-acting securing mechanism, the positive-acting securing mechanism is slipped onto the body in the longitudinal direction in such a manner that the insulator projects beyond the side of the securing mechanism facing away from the front end, and the securing mechanism contacts the external shoulder with no gap, while a section of the positive-acting securing mechanism that overlaps the retaining mechanism forms the first gap with the retaining mechanism as well as the second gap with the insulator.

12. The method according to claim 11, wherein the securing mechanism is joined to the external shoulder by welding and forming a weld seam extending around the entire circumference of the body.

13. The method according to claim 11, wherein during the fixing step, a shrinkage zone is heated by a current pulse flowing through the body while axial force is applied between the front end and the back end of the body.

* * * * *